US009145882B2

(12) United States Patent
Kim et al.

(10) Patent No.: US 9,145,882 B2
(45) Date of Patent: Sep. 29, 2015

(54) MICRO PUMP

(71) Applicant: SAMSUNG ELECTRO-MECHANICS CO., LTD., Suwon, Gyunggi-do (KR)

(72) Inventors: Sang Jin Kim, Gyunggi-do (KR); Bo Sung Ku, Gyunggi-do (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 336 days.

(21) Appl. No.: 13/783,181

(22) Filed: Mar. 1, 2013

(65) Prior Publication Data

US 2014/0178223 A1 Jun. 26, 2014

(30) Foreign Application Priority Data

Dec. 21, 2012 (KR) ..... 10-2012-0151470

(51) Int. Cl.

| | |
|---|---|
| ***F04B 17/00*** | (2006.01) |
| ***F04B 43/04*** | (2006.01) |
| ***F04B 53/10*** | (2006.01) |

(52) U.S. Cl.

CPC ..... *F04B 43/043* (2013.01); *F04B 43/046* (2013.01); *F04B 53/1052* (2013.01); *F04B 53/1062* (2013.01)

(58) Field of Classification Search

CPC ..... F04B 53/105; F04B 53/1052; F04B 53/1062; F04B 53/1065; F04B 43/043; F04B 43/046

USPC ..... 417/413.2, 413.3; 137/849, 855, 859

See application file for complete search history.

(56) References Cited

U.S. PATENT DOCUMENTS

| | | | | |
|---|---|---|---|---|
| 2,809,589 | A * | 10/1957 | Randolph | 417/413.1 |
| 6,116,866 | A * | 9/2000 | Tomita et al. | 417/413.2 |
| 7,033,148 | B2 * | 4/2006 | Bunner et al. | 417/413.1 |
| 8,579,606 | B2 * | 11/2013 | Chen et al. | 417/413.2 |
| 8,602,062 | B2 * | 12/2013 | Eiermann | 137/859 |
| 2004/0052657 | A1 * | 3/2004 | Van Lintel et al. | 417/322 |
| 2012/0085949 | A1 * | 4/2012 | Chen et al. | 251/129.01 |

FOREIGN PATENT DOCUMENTS

| | | | |
|---|---|---|---|
| JP | 2000-249074 | A | 9/2000 |
| KR | 2008-0070358 | A | 7/2008 |

* cited by examiner

*Primary Examiner* — Charles Freay

(74) *Attorney, Agent, or Firm* — NSIP Law

(57) ABSTRACT

There is provided a micro pump, including: a channel forming substrate having an inlet and an outlet; an upper substrate connected to the channel forming substrate and having a first hole connected to the inlet and a second hole connected to the outlet; and an adhesive member disposed between the channel forming substrate and the upper substrate to bond the channel forming substrate and the upper substrate and having a first valve opening and closing the inlet and a second valve opening and closing the outlet.

18 Claims, 16 Drawing Sheets

MICRO PUMP

CROSS-REFERENCE TO RELATED APPLICATIONS

This application claims the priority of Korean Patent Application No. 10-2012-0151470 filed on Dec. 21, 2012, in the Korean Intellectual Property Office, the disclosure of which is incorporated herein by reference.

BACKGROUND OF THE INVENTION

1. Field of the Invention

The present invention relates to a micro pump, and more particularly, to a micro pump, a valve of which may be easily manufactured.

2. Description of the Related Art

Observation of a reaction between a new medicine (that is, a drug) and a cell is required for developing new medicines and testing the stability thereof. In general, a reaction test between a drug and a cell is performed by using a culture dish, or the like.

However, since a reaction between a drug and a cell in a culture dish is significantly different from a reaction between a drug and a cell within a body, it is difficult to accurately observe or examine a reaction between a drug and a cell through only the result of a test using a culture dish. Therefore, development of a new device allowing for the observation of a reaction between a drug and a cell in a similar environment to that of the interior of a body is required.

To this end, a technology of circulating a culture medium has been developed. However, since a small amount of culture medium needs to be constantly supplied for smoothly culturing the cell, development of a micro pump that can constantly supply a small quantity of fluid is required.

Meanwhile, as related art inventions associated with micro pumps, Patent Document 1 and Patent Document 2 are provided. In both Patent Document 1 and Patent Document 2, a small quantity of fluid can be moved through driving force provided by a piezoelectric element. However, in Patent Document 1, since a valve able to completely interrupt the flow of fluid is not provided, it is difficult to transport a fixed quantity of fluid. In contrast thereto, in Patent Document 2, since valves 5 and 6 are provided on valve substrates 3 and 4, respectively, a fixed quantity of fluid may be transported, but it may be difficult to manufacture the valve substrates 3 and 4.

RELATED ART DOCUMENT (Patent Document 1) KR2008-070358A
(Patent Document 2) JP2000-249074A

SUMMARY OF THE INVENTION

An aspect of the present invention provides a micro pump that can constantly supply a small quantity of fluid.

An aspect of the present invention also provides a micro pump, a valve of which may be easily manufactured.

According to an aspect of the present invention, there is provided a micro pump, including: a channel forming substrate having an inlet and an outlet; an upper substrate connected to the channel forming substrate and having a first hole connected to the inlet and a second hole connected to the outlet; and an adhesive member disposed between the channel forming substrate and the upper substrate to bond the channel forming substrate and the upper substrate and having a first valve opening and closing the inlet and a second valve opening and closing the outlet.

The inlet and the outlet may be formed in a first surface of the channel forming substrate, and a pressure chamber connecting the inlet and the outlet may be formed in a second surface of the channel forming substrate.

The micro pump may further include an actuator formed on the first surface of the channel forming substrate and applying pressure to the pressure chamber.

The adhesive member may be a film formed of a polymer material.

The adhesive member may include a plurality of cut lines partitioning the first valve and the second valve.

The plurality of cut lines may include a first cut line defining first areas of the first valve and the second valve, and a second cut line defining second areas of the first valve and the second valve.

The first cut line may be longer than the second cut line.

The first cut line may have a curved shape having a first radius and the second cut line may have a curved shape having a second radius.

The first radius may be greater than the second radius.

The inlet may be formed by a semicircle having a third radius larger than the first radius and a semicircle having a fourth radius smaller than the second radius, and the first hole may be formed by a semicircle having a fifth radius smaller than the first radius and a semicircle having a sixth radius larger than the second radius.

The second hole may be formed by a semicircle having a third radius larger than the first radius and a semicircle having a fourth radius smaller than the second radius, and the outlet may be formed by a semicircle having a fifth radius smaller than the first radius and a semicircle having a sixth radius larger than the second radius.

The inlet may be larger than the first hole, the outlet may be smaller than the second hole, the first valve may be larger than the first hole and smaller than the inlet, and the second valve may be smaller than the second hole and larger than the outlet.

According to another aspect of the present invention, there is provided a micro pump, including: a lower substrate having a pressure chamber formed therein; a channel forming substrate having an inlet and an outlet formed therein, the inlet and the outlet being connected to the pressure chamber; an upper substrate connected to the channel forming substrate, and having a first hole connected to the inlet and a second hole connected to the outlet; and an adhesive member disposed between the channel forming substrate and the upper substrate to bond the channel forming substrate and the upper substrate and having a first valve opening and closing the inlet and a second valve opening and closing the outlet.

The micro pump may further include an actuator formed on the channel forming substrate and applying pressure to the pressure chamber.

The adhesive member may be a film formed of a polymer material.

The adhesive member may include a plurality of cut lines partitioning the first valve and the second valve.

The plurality of cut lines may include a first cut line defining first areas of the first valve and the second valve, and a second cut line defining second areas of the first valve and the second valve.

The first cut line may be longer than the second cut line.

The first cut line may have a curved shape having a first radius and the second cut line may have a curved shape having a second radius.

The first radius may be greater than the second radius.

The inlet may be formed by a semicircle having a third radius larger than the first radius and a semicircle having a fourth radius smaller than the second radius, and the first hole may be formed by a semicircle having a fifth radius smaller than the first radius and a semicircle having a sixth radius larger than the second radius.

The second hole may be formed by a semicircle having a third radius larger than the first radius and a semicircle having a fourth radius smaller than the second radius, and the outlet may be formed by a semicircle having a fifth radius smaller than the first radius and a semicircle having a sixth radius larger than the second radius.

The inlet may be larger than the first hole, the outlet may be smaller than the second hole, the first valve may be larger than the first hole and smaller than the inlet, and the second valve may be smaller than the second hole and larger than the outlet.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
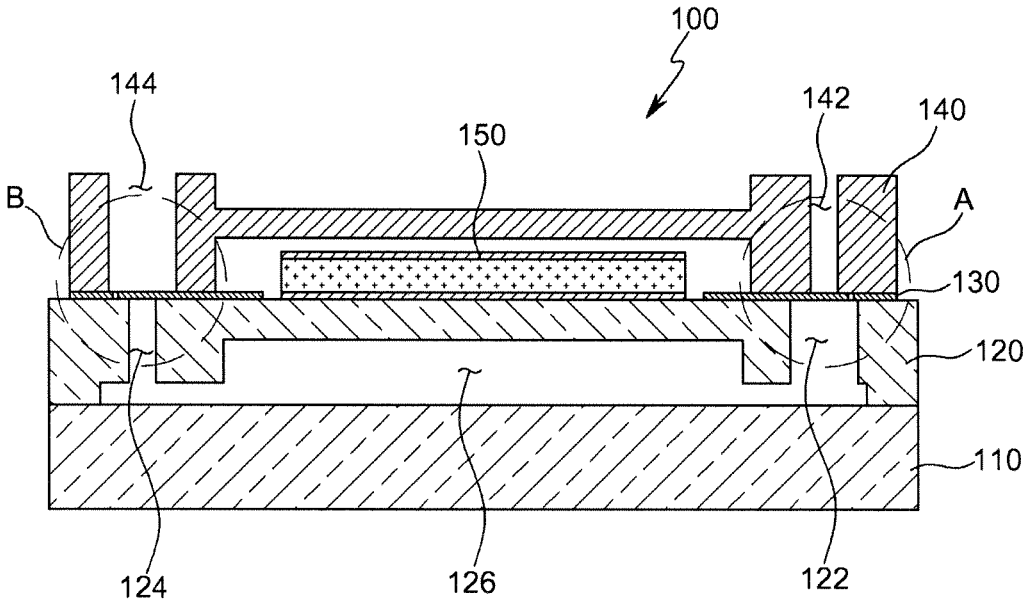
FIG. 1 is a cross-sectional view of a micro pump according to an embodiment of the present invention.

Hereinafter, embodiments of the present invention will be described in detail with reference to the accompanying drawings.

The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In the drawings, the shapes and dimensions of elements may be exaggerated for clarity, and the same reference numerals will be used throughout to designate the same or like elements.

Figure 2:
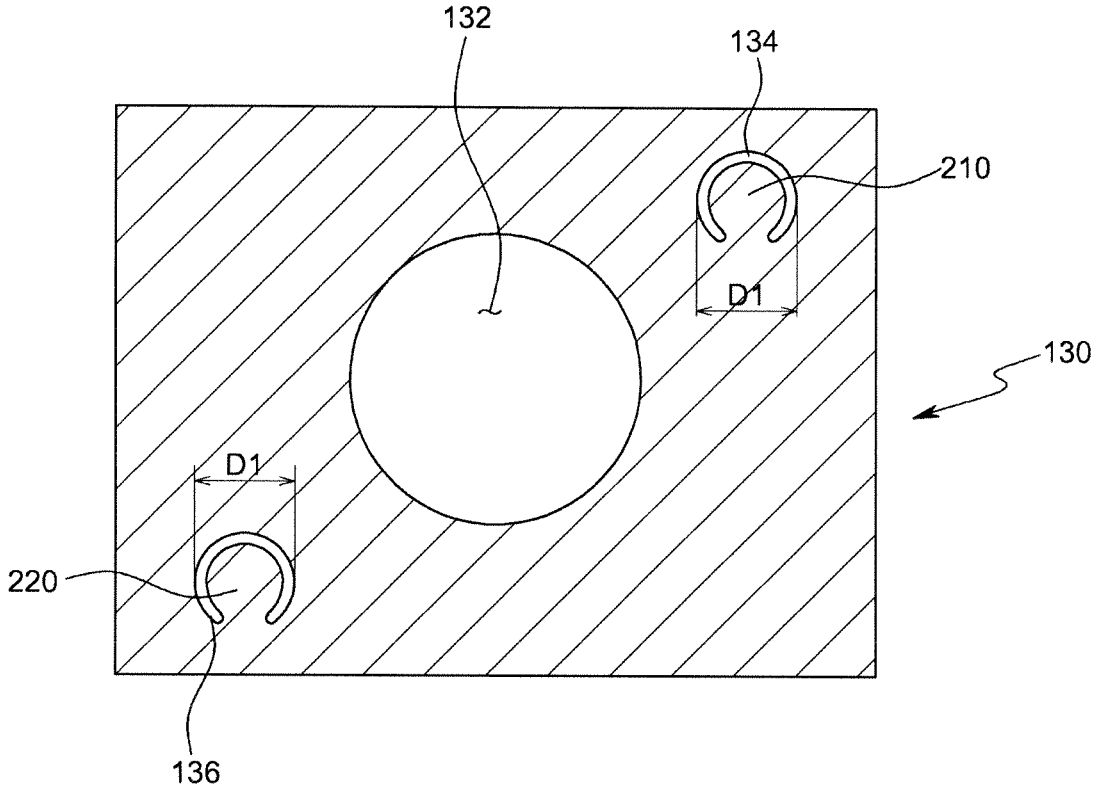
FIG. 2 is a plan view of a adhesive member of FIG. 1.
Figure 3:
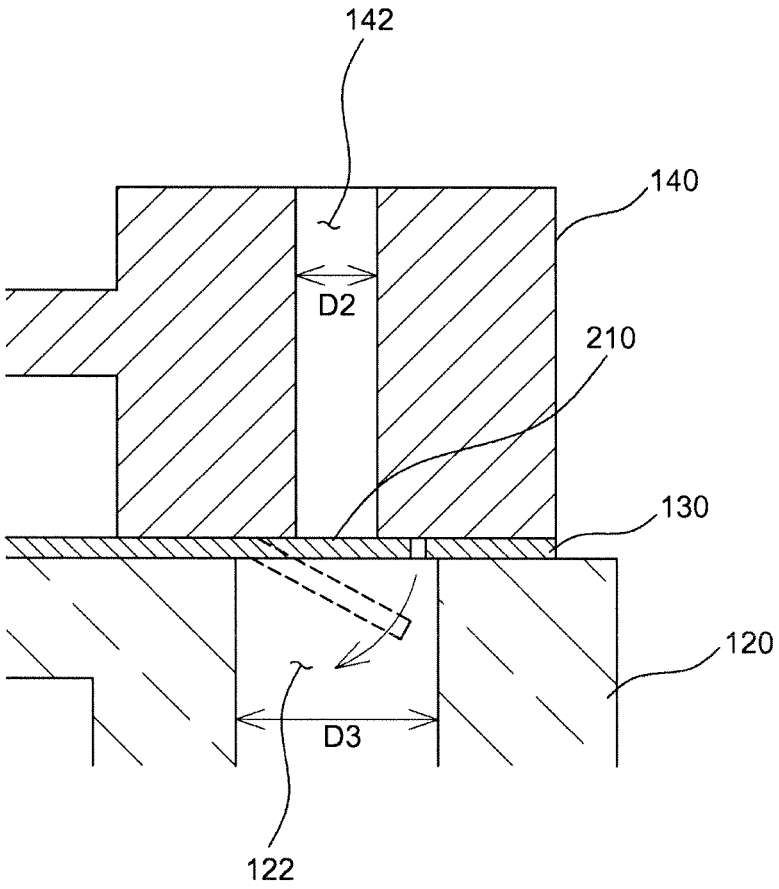
FIG. 3 is an enlarged cross-sectional view of part A of FIG. 1.
Figure 4:
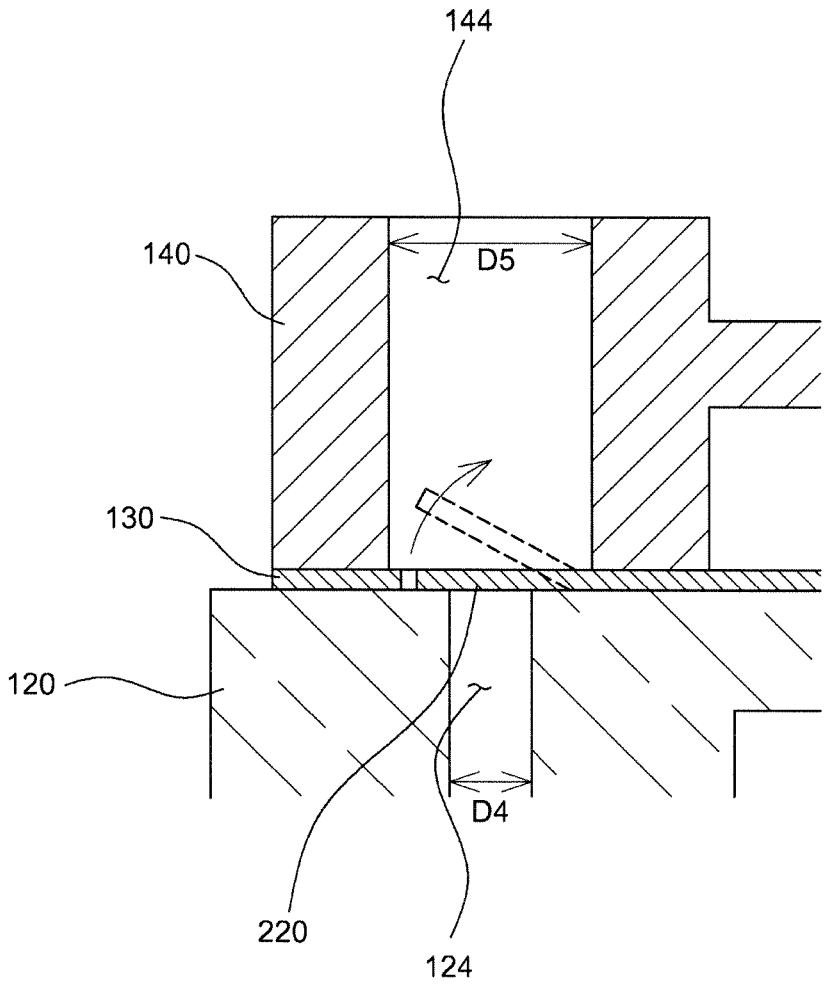
FIG. 4 is an enlarged cross-sectional view of part B of FIG. 1.
Figure 5:
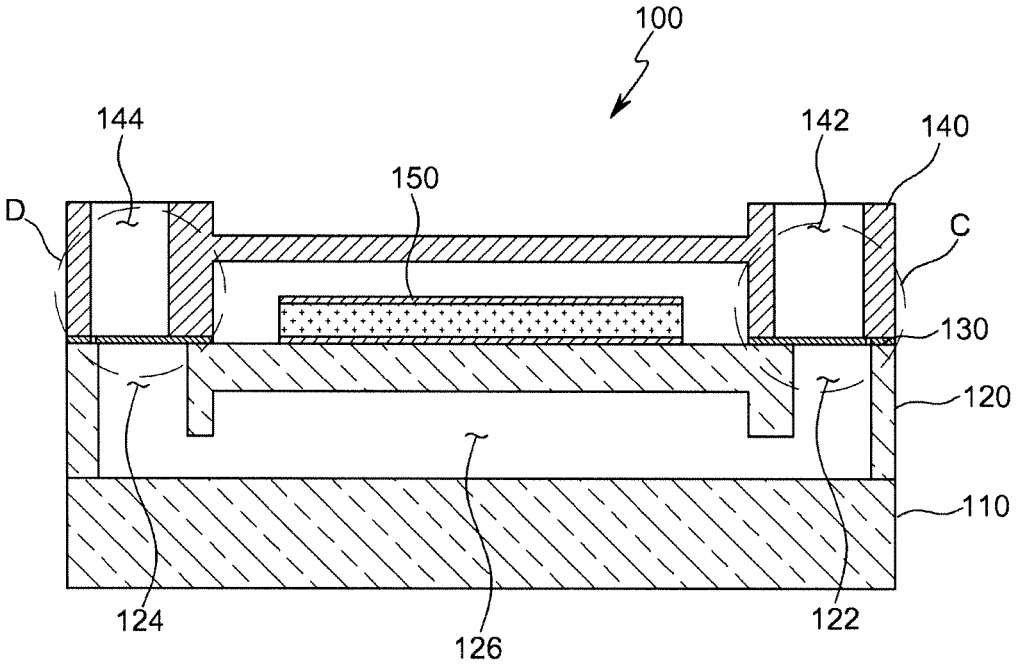
FIG. 5 is a cross-sectional view of a micro pump according to another embodiment of the present invention.
Figure 6:
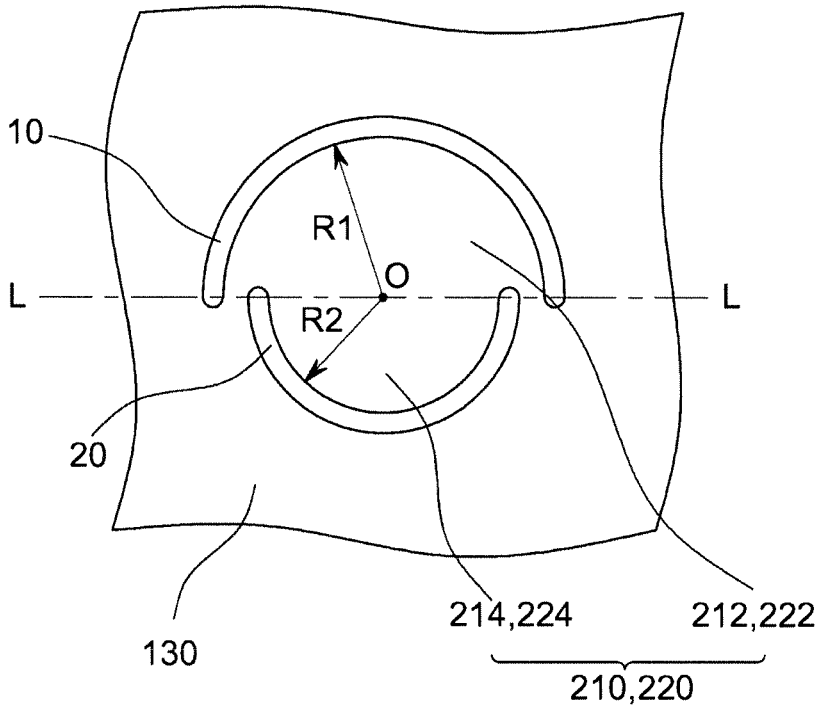
FIG. 6 is an enlarged diagram of a valve formed in a adhesive member of FIG. 5.
Figure 7:
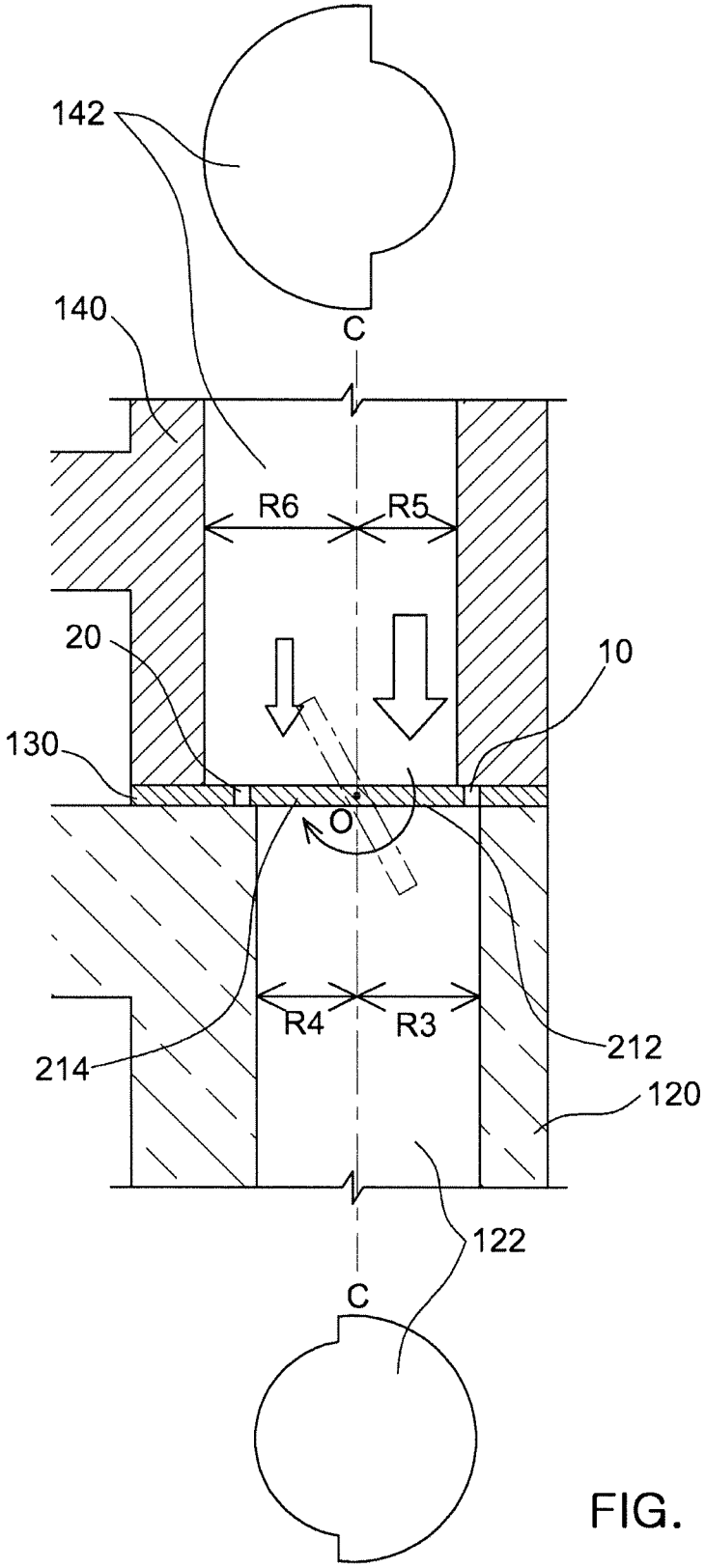
FIG. 7 is an enlarged cross-sectional view of part C of FIG. 5.
Figure 8:
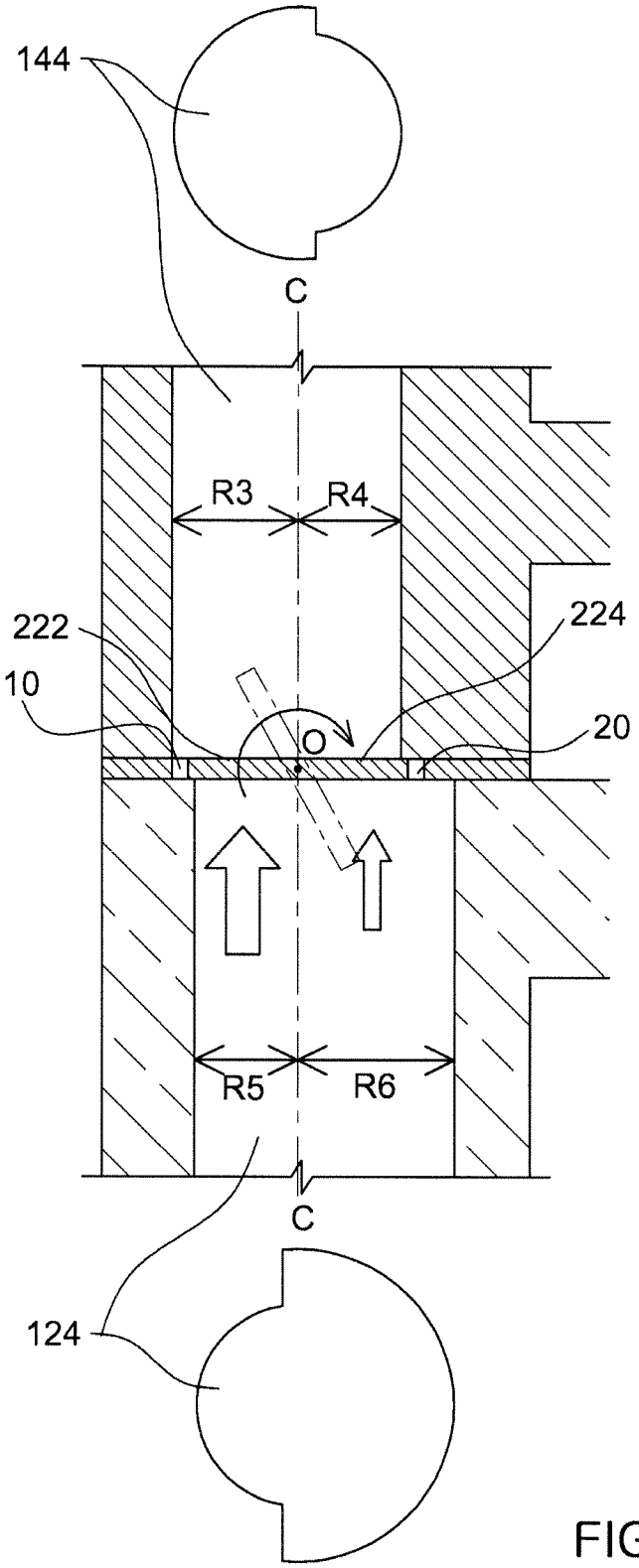
FIG. 8 is an enlarged cross-sectional view of part D of FIG. 5.

FIG. 1 is a cross-sectional view of a micro pump according to an embodiment of the present invention. FIG. 2 is a plan view of an adhesive member of FIG. 1. FIG. 3 is an enlarged cross-sectional view of part A of FIG. 1. FIG. 4 is an enlarged cross-sectional view of part B of FIG. 1. FIG. 5 is a cross-sectional view of a micro pump according to another embodiment of the present invention. FIG. 6 is an enlarged diagram of a valve formed in an adhesive member of FIG. 5. FIG. 7 is an enlarged cross-sectional view of part C of FIG. 5. FIG. 8 is an enlarged cross-sectional view of part D of FIG. 5. FIGS. 9 through 15 are diagrams illustrating other forms of the valve formed in the adhesive member. FIG. 16 is a cross-sectional view of a micro pump according to another embodiment of the present invention.

Referring to FIGS. 1 to 4, a micro pump 100 according to an embodiment of the present invention will be described.

The micro pump 100 according to the present embodiment may include a lower substrate 110, a channel forming substrate 120, an adhesive member 130, and an upper substrate 140. Moreover, the micro pump 100 may further include an actuator 150 as necessary. Herein, the lower substrate 110, the channel forming substrate 120, and the upper substrate 140 may be sequentially stacked. Moreover, the adhesive member 130 may be disposed between the channel forming substrate 120 and the upper substrate 140.

The lower substrate 110 may form a base of the micro pump 100. The lower substrate 110 may be formed of a single crystal silicon or silicon on insulator (SOI) substrate. In this case, the lower substrate 110 may have a stack structure in which a silicon substrate and a plurality of insulating members are stacked.

The channel forming substrate 120 may be a substrate where a channel through which a fluid (for example, a culture medium or a drug) is transported is formed. To this end, an inlet 122 and an outlet 124 may be formed in a first surface (a top surface in FIG. 1) of the channel forming substrate 120 and a pressure chamber 126 may be formed in a second surface (a bottom surface in FIG. 1). Herein, the pressure chamber 126 may connect the inlet 122 and the outlet 124 to each other and may have a volume sufficient to receive a predetermined quantity of fluid.

The channel forming substrate 120 may be formed of a single crystal silicon or silicon on insulator (SOI) substrate, similar to the lower substrate 110. The channel forming substrate 120 may be formed integrally with the lower substrate 110 through a sintering process.

The upper substrate 140 may be formed on one surface of the channel forming substrate 120. The upper substrate 140 may have a space for receiving the actuator 150 therein and thus, an external impact may be prevented from being directly transferred to the actuator 150.

A first hole 142 and a second hole 144 may be formed in the upper substrate 140. Herein, the first hole 142 may be connected to the inlet 122 of the channel forming substrate 120 and the second hole 144 may be connected to the outlet 124 of the channel forming substrate 120.

The upper substrate 140 may be formed of a plastic or synthetic resin material. In this case, since the upper substrate 140 and valves 210 and 220 are easily processed, a manufacturing cost of the upper substrate 140 may be reduced. However, the upper substrate 140 may be manufactured using a silicon substrate as necessary and only the valves 210 and 220 may be formed of the plastic or synthetic resin material.

The adhesive member 130 may be disposed between the channel forming substrate 120 and the upper substrate 140. Specifically, the adhesive member 130 is disposed on a bonding surface of the channel forming substrate 120 and the upper substrate 140 to thereby bond the channel forming substrate 120 and the upper substrate 140. To this end, the adhesive member 130 may be manufactured using a material containing an adhesive substance.

The adhesive member 130 may be formed of a polymer material and may have predetermined adhesive properties by plasma processing. When the adhesive member 130 configured as above is disposed between the channel forming substrate 120 and the upper substrate 140 and receives predetermined heat, the adhesive properties may be generated to strongly bond the channel forming substrate 120 and the upper substrate 140.

The adhesive member 130 may have a shape corresponding to one surface of the channel forming substrate 120 or the upper substrate 140. For example, the adhesive member 130 may have a substantially rectangular cross section as illustrated in FIG. 2. A through-hole 132 may be formed at the center of the adhesive member 130. The through-hole 132 may have a shape corresponding to the actuator 150. Therefore, the actuator 150 formed on the channel forming substrate 120 may protrude upwardly without being interfered by the adhesive member 130.

A plurality of valves 210 and 220 may be formed in the adhesive member 130. Specifically, the first valve 210 may be formed in a position corresponding to the inlet 122 of the channel forming substrate 120 and the second valve 220 may be formed in a position corresponding to the outlet 124 of the channel forming substrate 120. Herein, the valves 210 and 22 may be formed by cut lines 134 and 136, respectively, as illustrated in FIG. 2. Specifically, the valves 210 and 220 may be formed on ring-shaped cut lines 134 and 136 cutting the adhesive member 130, respectively. Herein, the cut lines 134 and 136 may be formed while molding or processing the adhesive member 130. The valves 210 and 220 formed as above may have a circular shape having a predetermined diameter D1 and may be bent vertically (a vertical direction based on FIG. 1).

The actuator 150 may be formed on the channel forming substrate 120. Specifically, the actuator 150 may be formed on one surface (a top surface in FIG. 1) of the channel forming substrate 120. The actuator 150 may be constituted of a lower electrode, a piezoelectric element, and an upper electrode. Specifically, the lower electrode may be formed on the top of the channel forming substrate 120, the piezoelectric element may be formed on the top of the lower electrode, and the upper electrode may be formed on the top of the piezoelectric element. The actuator 150 configured as above may generate driving force as the piezoelectric element is deformed by a current signal supplied through the upper electrode and the lower electrode. Herein, the driving force of the actuator 150 is transferred to the pressure chamber 126 of the channel forming substrate 120 to cause a flow of fluid.

The micro pump 100 configured as above may restrict the flow of the fluid to one direction only through the valves 210 and 220 formed in the adhesive member 130. Specifically, the first valve 210 disposed between the first hole 142 and the inlet 122 may only allow for the downward flow of the fluid and the second valve 220 disposed between the second hole 144 and the outlet 124 may only allow for the upward flow of the fluid. A detailed description thereof will be provided with reference to FIGS. 3 and 4.

The inlet side (part A of FIG. 1) of the micro pump 100 may be configured as illustrated in FIG. 3. Specifically, the first hole 142 of the upper substrate 140 may have a second diameter D2 smaller than a first diameter D1 of the first valve 210, and the inlet 122 of the channel forming substrate 120 may have a third diameter D3 larger than the first diameter D1 of the first valve 210. Therefore, the first valve 210 may not be bent toward the first hole 142, but may be bent toward the inlet 122 (see a dotted line of FIG. 3).

Accordingly, only the movement of the fluid flowing into the micro pump 100 from the outside may be allowed at the inlet side of the micro pump 100. That is, when the fluid moves from the first hole 142 to the inlet 122, the inlet 122 is opened as the first valve 210 is bent downward, and thus, the movement of the fluid may be allowed. However, when the fluid moves from the inlet 122 to the first hole 142, the first valve 210 is not bent upward and the first hole 142 is closed, and thus, the movement of the fluid may be interrupted.

To the contrary, the outlet side (part B of FIG. 1) of the micro pump 100 may be opposed to the inlet side as illustrated in FIG. 4. Specifically, the outlet 124 of the channel forming substrate 120 may have a fourth diameter D4 smaller than the first diameter D1 of the second valve 220 and the second hole 144 of the upper substrate 140 may have a fifth diameter D5 larger than the first diameter D1 of the second valve 220. Therefore, the second valve 220 may not be bent toward the outlet 124, but may be bent toward the second hole 144 (see a dotted line of FIG. 4).

Accordingly, only the movement of the fluid that is discharged to the outside from the micro pump 100 may be allowed at the outlet side of the micro pump 100. That is, when the fluid moves from the second hole 144 to the outlet 124, the second valve 220 is not bent downward and the outlet 124 is closed, and thus, the movement of the fluid may be interrupted. However, when the fluid moves from the outlet 124 to the second hole 144, the outlet 124 is opened as the second valve 220 is bent upward, and as thus, the movement of the fluid may be allowed.

In the micro pump 100 configured as above, since a movement direction of fluid is controlled by the valves 210 and 220, a small quantity of fluid may be constantly moved. Moreover, in the micro pump 100, since the minute valves 210 and 220 are directly formed in the adhesive member 130, a manufacturing process of the micro pump 100 may be simplified and manufacturing costs of the micro pump 100 may be reduced.

Next, a micro pump according to another embodiment of the present invention will be described. For reference, the same reference numerals will be used to designate the same components as those of the aforementioned embodiment and a detailed description thereof will be omitted.

Referring to FIGS. 5 to 15, a micro pump according to another embodiment of the present invention will be described.

The micro pump 100 according to the present embodiment may be distinguished from that of the aforementioned embodiment in shapes of the inlet 122, the outlet 124, the first hole 142, the second hole 144, and the valves 210 and 220.

Figure 9:
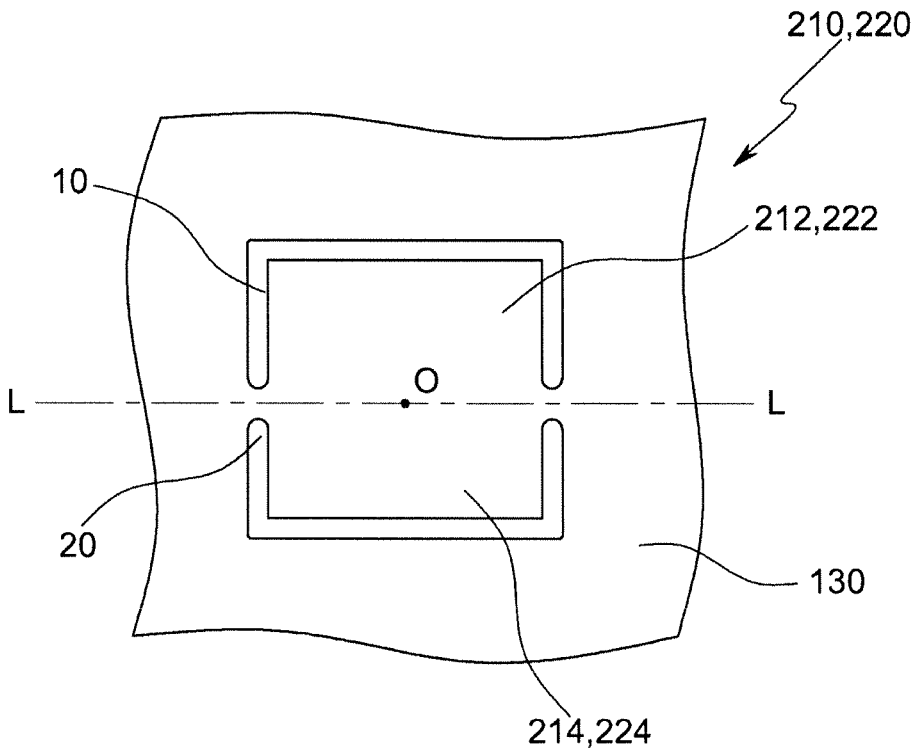
FIGS. 9 through 15 are diagrams illustrating other forms of the valve formed in the adhesive member.
Figure 10:
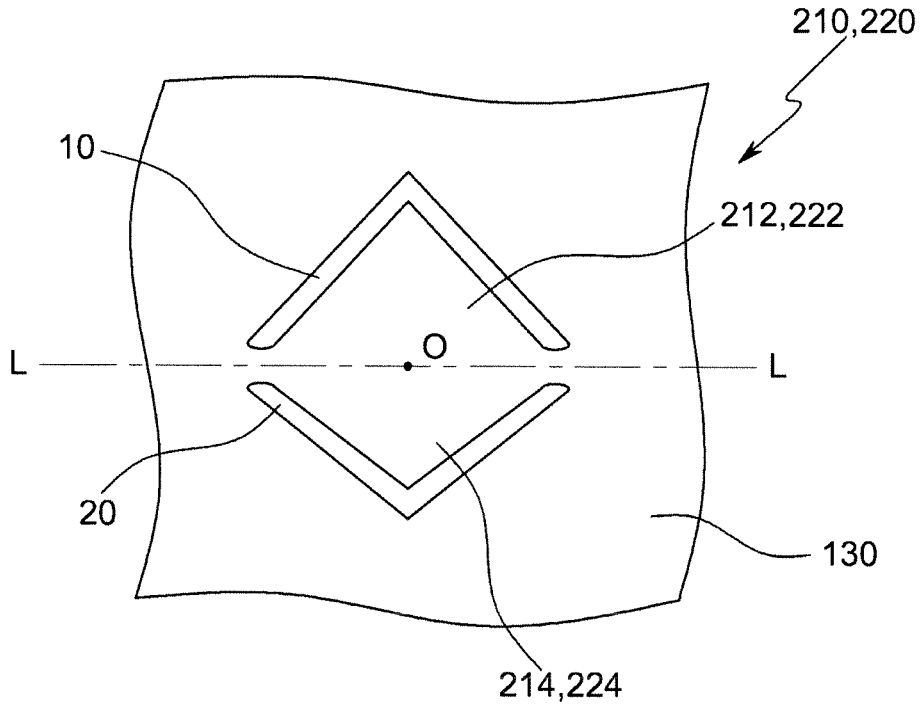

The valves 210 and 220 according to the present embodiment may be constituted of first areas 212 and 222 and second areas 214 and 224 as illustrated in FIG. 6. Specifically, the valves 210 and 220 may be constituted of the first areas 212 and 222 formed by a first cut line 10 and the second areas 214 and 224 formed by a second cut line 20. Herein, the first cut line 10 is a curved line having a first radius R1 and the second cut line 20 may be a curved line having a second radius R2. However, the shape of the cut lines 10 and 20 are not limited thereto. For example, the cut lines 10 and 20 may have a triangular or rectangular shape as illustrated in FIGS. 9 and 10. For reference, the first cut line 10 and the second cut line 20 may be formed while molding or processing the adhesive member 130.

The first areas 212 and 222 and the second areas 214 and 224 may be bent based on a horizontal line segment L-L. Specifically, the first areas 212 and 222 and the second areas 214 and 224 may be rotated around a central axis based on the horizontal line segment L-L. Herein, rotational directions of the first areas 212 and 222 and the second areas 214 and 224 may depend on installation positions of the valves 210 and 220.

Meanwhile, since the first areas 212 and 222 and the second areas 214 and 224 have different dimensions, force having different magnitudes may be applied to the first areas 212 and 222 and the second areas 214 and 224. Since this causes unbalance of force between the first areas 212 and 222 and the second areas 214 and 224, rotational motions of the valves 210 and 220 using the horizontal line segment L-L as the central axis may be naturally induced. Accordingly, according to the present embodiment, the first areas 212 and 222 and the second areas 214 and 224 are opened or closed simultaneously to control the flow of the fluid.

Hereinafter, opening/closing operations of the valves 210 and 220 will be described with reference to FIGS. 7 and 8.

At the inlet side of the micro pump 100, the valves 210, 212, and 214 may be opened only in the case in which the fluid moves to the inside of the micro pump 100.

To this end, the inlet 122 and the first hole 142 may have a shape appropriate for partially receiving any one of the first area 212 and the second area 214 of the valve 210. Specifically, the inlet 122 may have a shape including a semicircle having a third radius R3 larger than the first radius R1 of the first area 212 and a semicircle having a fourth radius R4 smaller than the second radius R2 of the second area 214. On the other hand, the first hole 142 may have a shape including a semicircle having a fifth radius R5 smaller than the first radius R1 of the first area 212 and a semicircle having a sixth radius R6 larger than the second radius R2 of the second area 214.

The inlet side of the micro pump 100 configured as above may only allow the fluid to flow from the first hole 142 to the inlet 122 as illustrated in FIG. 7.

At the outlet side of the micro pump 100, the valves 210, 212, and 214 may be opened only in the case in which the fluid is discharged to the outside of the micro pump 100.

To this end, the outlet 124 and the second hole 144 may have a shape appropriate for partially receiving any one of the first area 212 and the second area 214 of the valve 210. Specifically, the second hole 144 may have a shape including a semicircle having the third radius R3 larger than the first radius R1 of the first area 212 and a semicircle having the fourth radius R4 smaller than the second radius R2 of the second area 214. In addition, the outlet 124 may have a shape including a semicircle having the fifth radius R5 smaller than the first radius R1 of the first area 212 and a semicircle having the sixth radius R6 larger than the second radius R2 of the second area 214.

The outlet side of the micro pump 100 configured as above may only allow the fluid to flow from the outlet 124 to the second hole 144 as illustrated in FIG. 8.

Figure 11:
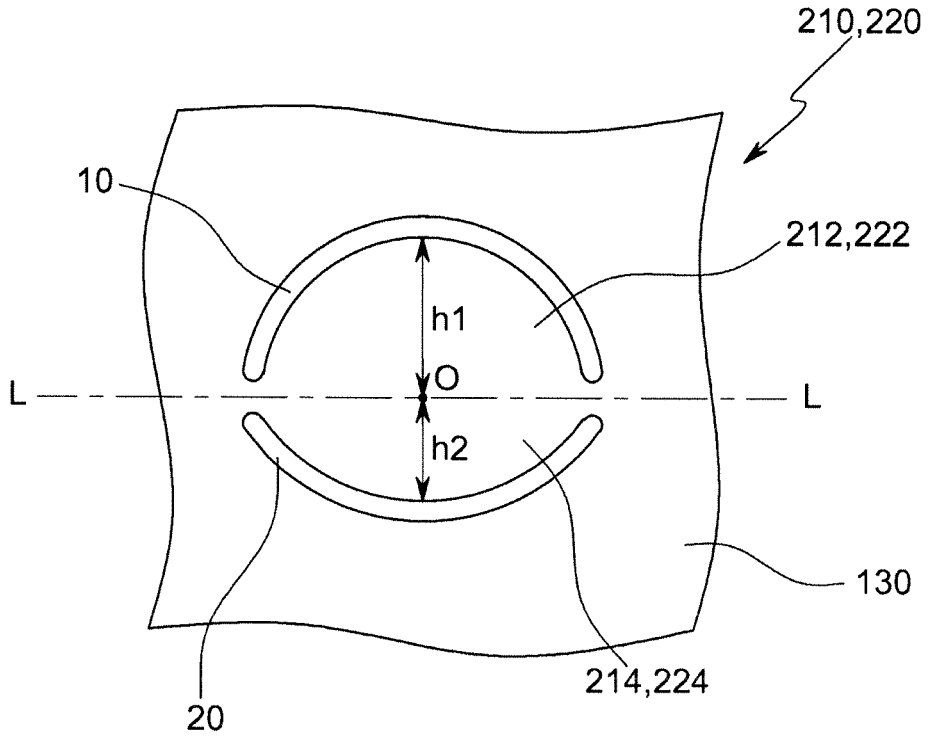

Next, referring to FIGS. 11 through 13, other forms of the valves 210 and 220 that may be formed in the adhesive member 130 will be described.

The other forms of the valves 210 and 220 may be distinguished from the aforementioned forms in that distances from a center point O to apexes of the cut lines 10 and 20 are different from each other. That is, a distance h1 from the center point O to the apex of the first cut line 10 may be different from a distance h2 from the center point O to the second cut line 20.

This structure may naturally induce a difference in dimensions between the first areas 212 and 222 and the second areas 214 and 224. Moreover, since a portion between both ends of the first cut line 10 and both ends of the second cut line 20 serves as a rotational axis, the first areas 212 and 222 and the second areas 214 and 224 may smoothly rotate.

Figure 12:
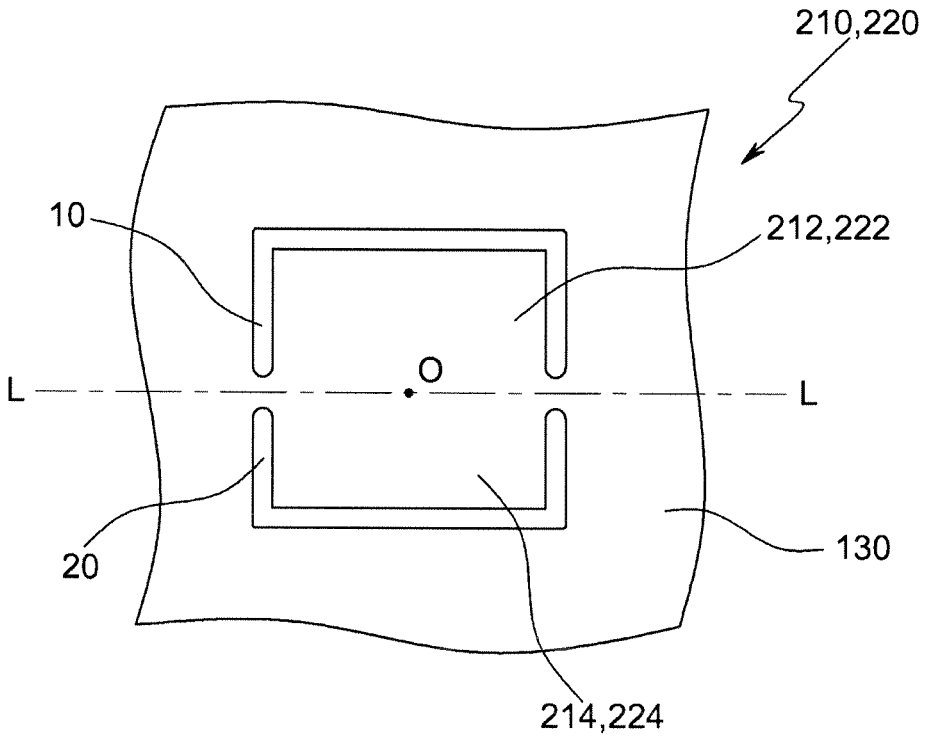
Figure 13:
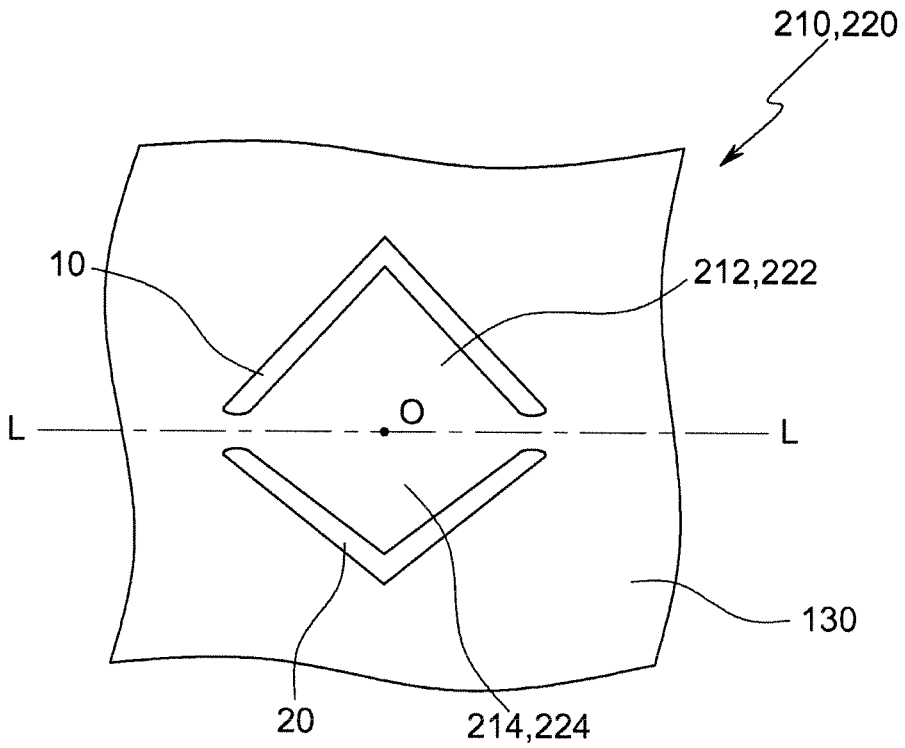

Meanwhile, the shapes of the first areas 212 and 222 and the second areas 214 and 224 may be deformed as illustrated in FIGS. 12 and 13, and to this end, the first cut line 10 and the second cut line 20 may be formed of a plurality of straight lines.

Figure 14:
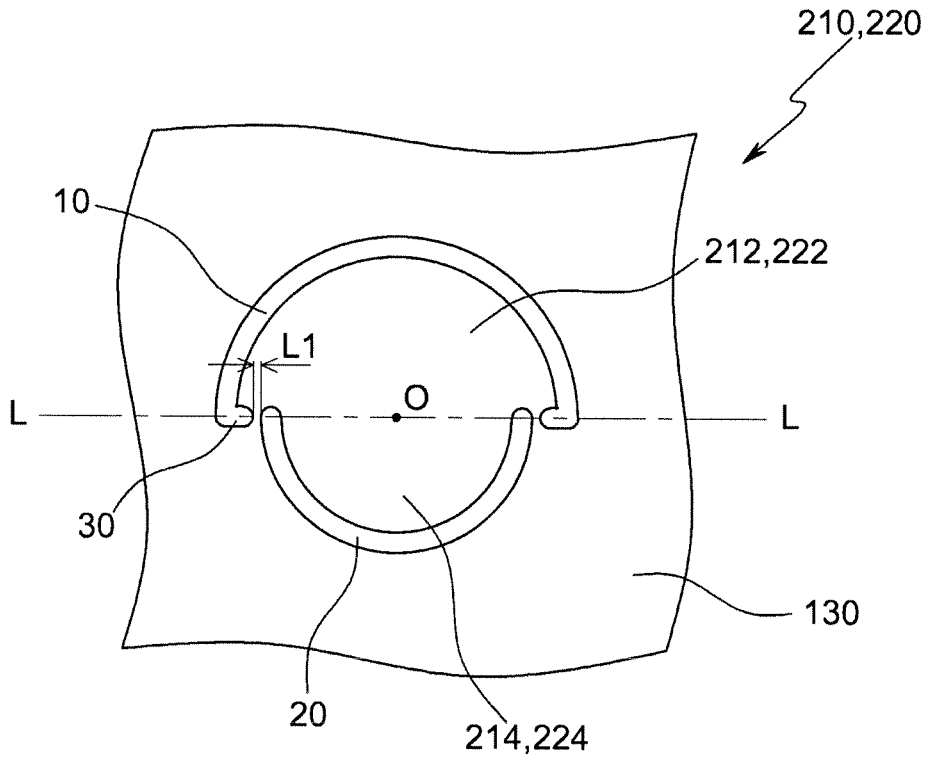

Next, referring to FIGS. 14 and 15, other forms of the valves 210 and 220 that may be formed in the adhesive member 130 will be described.

The valves 210 and 220 may be distinguished from those of the aforementioned embodiments in that a third cut line 30 and a fourth cut line 40 are further provided. That is, the valves 210 and 220 of FIG. 14 may further include the third cut line 30. The third cut line 30 may extend inwardly (toward the center point O) from both ends of the first cut line 10. The third cut line 30 is not connected to the second cut line 20, but is aligned with both ends of the second cut line 20.

In the valves 210 and 220 formed as above, since connection lengths L1 between the other portions of the adhesive member 130 and the first areas 212 and 222 are shortened by the third cut line 30, the first areas 212 and 222 may be smoothly moved.

Figure 15:
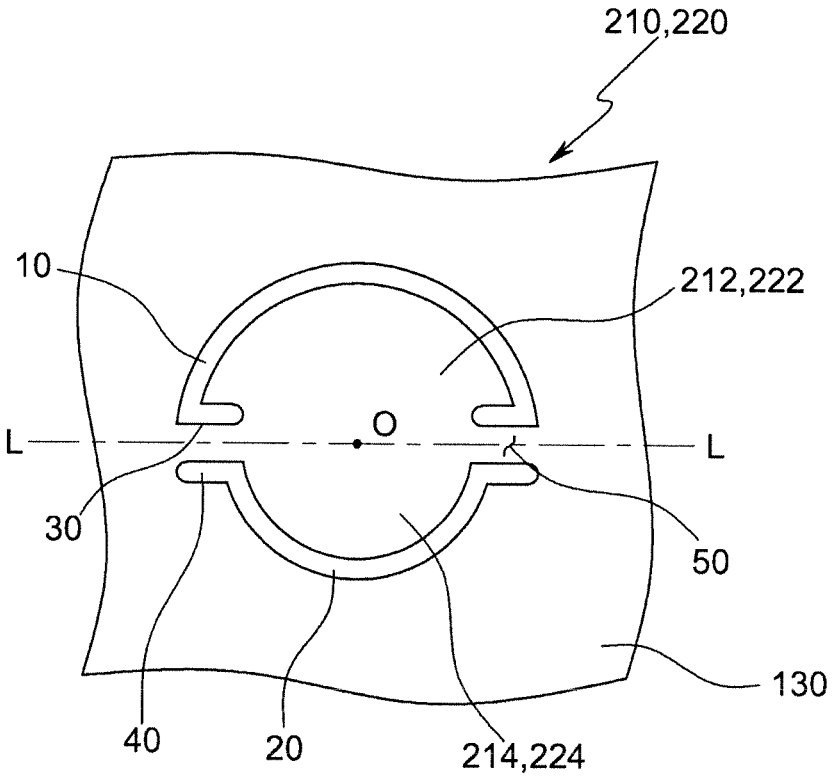
Figure 16:
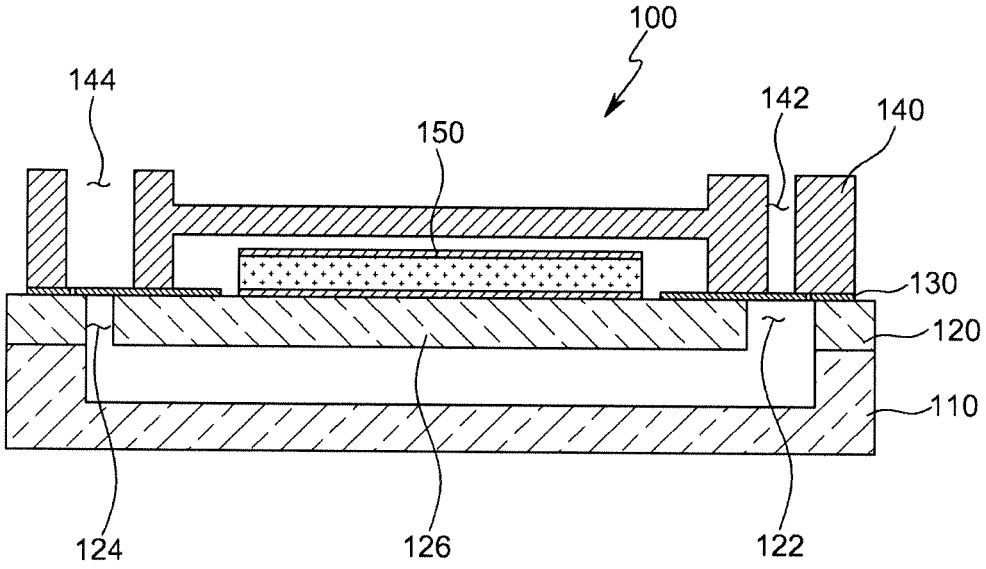
FIG. 16 is a cross-sectional view of a micro pump according to another embodiment of the present invention.

The valves 210 and 220 may further include the third cut line 30 and the fourth cut line 40 as illustrated in FIG. 15. The third cut line 30 may extend inwardly from both ends of the first cut line 10 and the fourth cut line 40 may extend outwardly from both ends of the second cut line 20. Herein, since both ends of the first cut line 10 and both ends of the second cut line 20 are formed to be separated from each other by a predetermined interval, the third cut line 30 and the fourth cut line 40 may not be connected to each other.

In the valves 210 and 220 formed as above, since a rotational axis 50 of the first areas 212 and 222 and the second areas 214 and 224 is formed by the third cut line 30 and the fourth cut line 40, the first areas 212 and 222 and the second areas 214 and 224 may smoothly rotate.

Next, referring to FIG. 16, a micro pump 100 according to another embodiment of the present invention will be described.

The micro pump 100 according to the present embodiment may be distinguished from that according to the aforementioned embodiments in the structures of the lower substrate 110 and the channel forming substrate 120. Specifically, in the present embodiment, the inlet 122 and the outlet 124 may be formed in the channel forming substrate 120 and the pressure chamber 116 may be formed in the lower substrate 110.

In the micro pump 100 configured as above, the channel forming substrate 120 is easily manufactured and thinned. Specifically, since only the inlet 122 and the outlet 124 are formed in the channel forming substrate 120, the channel forming substrate 120 is more easily manufactured through an etching process as compared with the channel forming substrate according to the aforementioned embodiment.

As set forth above, according to embodiments of the present invention, a micro pump can effectively transport a fluid including a micro-sized material.

Moreover, since a micro valve is easily manufactured, a manufacturing process of the micro pump can be simplified and manufacturing costs thereof can be reduced.

While the present invention has been shown and described in connection with the embodiments, it will be apparent to those skilled in the art that modifications and variations can be made without departing from the spirit and scope of the invention as defined by the appended claims.

What is claimed is:

1. A micro pump, comprising:

a channel forming substrate having an inlet and an outlet;

an upper substrate connected to the channel forming substrate and having a first hole connected to the inlet and a second hole connected to the outlet; and an adhesive member disposed between the channel forming substrate and the upper substrate to bond the channel forming substrate and the upper substrate and having a first valve opening and closing the inlet and a second valve opening/closing the outlet, wherein the adhesive member includes:

a first cut line defining first areas of the first valve and the second valve; and a second cut line defining second areas of the first valve and the second valve, wherein the first cut line has a curved shape having a first radius, and the second cut line has a curved shape having a second radius, wherein the first radius is greater than the second radius, wherein the inlet is formed by a semicircle having a third radius larger than the first radius and a semicircle having a fourth radius smaller than the second radius, and the first hole is formed by a semicircle having a fifth radius smaller than the first radius and a semicircle having a sixth radius larger than the second radius.

2. The micro pump of claim 1, wherein the inlet and the outlet are formed in a first surface of the channel forming substrate, and a pressure chamber connecting the inlet and the outlet is formed in a second surface of the channel forming substrate.

3. The micro pump of claim 2, further comprising an actuator formed on the first surface of the channel forming substrate and applying pressure to the pressure chamber.

4. The micro pump of claim 1, wherein the adhesive member is a film formed of a polymer material.

5. The micro pump of claim 1, wherein the first cut line is longer than the second cut line.

6. The micro pump of claim 1, wherein the second hole is formed by a semicircle having a seventh radius larger than the first radius and a semicircle having an eighth radius smaller than the second radius, and the outlet is formed by a semicircle having a ninth radius smaller than the first radius and a semicircle having a tenth radius larger than the second radius.

7. The micro pump of claim 1, wherein the inlet is larger than the first hole, the outlet is smaller than the second hole, the first valve is larger than the first hole and smaller than the inlet, and the second valve is smaller than the second hole and larger than the outlet.

8. The micro pump of claim 1, further comprising a lower substrate having a pressure chamber formed therein, wherein the inlet and the outlet are connected to the pressure chamber.

9. The micro pump of claim 8, further comprising an actuator formed on the channel forming substrate and applying pressure to the pressure chamber.

10. A micro pump, comprising:

a channel forming substrate having an inlet and an outlet;

an upper substrate connected to the channel forming substrate, and having a first hole connected to the inlet and a second hole connected to the outlet; and an adhesive member disposed between the channel forming substrate and the upper substrate to bond the channel forming substrate and the upper substrate and having a first valve opening and closing the inlet and a second valve opening and closing the outlet, wherein the adhesive member includes:

a first cut line defining first areas of the first valve and the second valve; and a second cut line defining second areas of the first valve and the second valve, wherein the first cut line has a curved shape having a first radius, and the second cut line has a curved shape having a second radius, wherein the first radius is greater than the second radius, wherein the second hole is formed by a semicircle having a third radius larger than the first radius and a semicircle having a fourth radius smaller than the second radius, and the outlet is formed by a semicircle having a fifth radius smaller than the first radius and a semicircle having a sixth radius larger than the second radius.

11. The micro pump of claim 10, wherein the adhesive member is a film formed of a polymer material.

12. The micro pump of claim 10, wherein the first cut line is longer than the second cut line.

13. The micro pump of claim 10, wherein the inlet is formed by a semicircle having a seventh radius larger than the first radius and a semicircle having an eighth radius smaller than the second radius, and the first hole is formed by a semicircle having a ninth radius smaller than the first radius and a semicircle having a tenth radius larger than the second radius.

14. The micro pump of claim 10, wherein the inlet is larger than the first hole, the outlet is smaller than the second hole, the first valve is larger than the first hole and smaller than the inlet, and the second valve is smaller than the second hole and larger than the outlet.

15. The micro pump of claim 10, wherein the inlet and the outlet are formed in a first surface of the channel forming substrate, and a pressure chamber connecting the inlet and the outlet is formed in a second surface of the channel forming substrate.

16. The micro pump of claim 15, further comprising an actuator formed on the first surface of the channel forming substrate and applying pressure to the pressure chamber.

17. The micro pump of claim 10, further comprising a lower substrate having a pressure chamber formed therein, wherein the inlet and the outlet are connected to the pressure chamber.

18. The micro pump of claim 17, further comprising an actuator formed on the channel forming substrate and applying pressure to the pressure chamber.

* * * * *